US010427426B2

(12) United States Patent
Okeguchi et al.

(10) Patent No.: US 10,427,426 B2
(45) Date of Patent: Oct. 1, 2019

(54) RECORDING APPARATUS

(71) Applicant: RICOH COMPANY, LTD., Tokyo (JP)

(72) Inventors: Muneyuki Okeguchi, Kanagawa (JP); Kazuyoshi Matsumoto, Tokyo (JP); Kunihiko Nishioka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/008,329

(22) Filed: Jun. 14, 2018

(65) Prior Publication Data

US 2018/0361761 A1 Dec. 20, 2018

(30) Foreign Application Priority Data

Jun. 16, 2017 (JP) ..... 2017-118583
May 16, 2018 (JP) ..... 2018-094608

(51) Int. Cl.
*B41J 11/00* (2006.01)
*B41J 2/01* (2006.01)
*B41J 3/36* (2006.01)

(52) U.S. Cl.
CPC ..... *B41J 11/0095* (2013.01); *B41J 2/01* (2013.01); *B41J 3/36* (2013.01)

(58) Field of Classification Search
CPC ..... B41J 2/01; B41J 11/0095; B41J 3/36
USPC ..... 347/109
See application file for complete search history.

(56) References Cited

U.S. PATENT DOCUMENTS 5,816,718 A * 10/1998 Poole ..... B41J 3/36 400/88
6,846,119 B2 * 1/2005 Walling ..... B41J 3/36 347/109
7,735,951 B2 * 6/2010 Ahne ..... B41J 29/393 347/108
2007/0098474 A1 * 5/2007 Studer ..... B41J 3/28 400/283
2008/0144053 A1 6/2008 Gudan et al.
2017/0266955 A1 9/2017 Harada et al.

FOREIGN PATENT DOCUMENTS

JP 63-178659 7/1988
JP 1-259972 10/1989
JP 3-158271 7/1991
JP 5-116380 5/1993
JP 6-297776 10/1994
JP 8-067032 3/1996
JP 9-131927 5/1997
JP 2004-508218 3/2004
JP 2008-094101 4/2008

(Continued)

*Primary Examiner* — Huan H Tran
*Assistant Examiner* — Alexander D Shenderov
(74) *Attorney, Agent, or Firm* — Xsensus LLP

(57) ABSTRACT

A hand-held recording apparatus includes a recording section, a housing, and an indicator. The recording section records an image on a recording material in moving in a scanning direction. The housing houses the recording section. The indicator is movable between an indication position at which the indicator opposes the recording material and indicates a recording area of the image of the recording section and a retracted position at which the indicator is retracted from the indication position.

15 Claims, 9 Drawing Sheets

(56) References Cited

FOREIGN PATENT DOCUMENTS

| | | |
|---|---|---|
| JP | 2016-087880 | 5/2016 |
| JP | 2016-112700 | 6/2016 |
| JP | 2017-170879 | 9/2017 |
| WO | WO2001/094118 A1 | 12/2001 |

* cited by examiner

RECORDING APPARATUS

CROSS-REFERENCE TO RELATED APPLICATIONS

This patent application is based on and claims priority pursuant to 35 U.S.C. § 119(a) to Japanese Patent Application Nos. 2017-118583, filed on Jun. 16, 2017, and 2018-094608, filed on May 16, 2018 in the Japan Patent Office, the entire disclosure of each of which is hereby incorporated by reference herein.

BACKGROUND

Technical Field

Aspects of the present disclosure relate to a recording apparatus, and more particularly to a manual-scanning-type recording apparatus.

Related Art

With the spread of laptop computers, smartphones, and the like, portable recording apparatuses are increasingly demanded. As a portable recording apparatus, for example, a recording apparatus is known that records an image while scanning a surface of a recording medium, such as a sheet of paper, with a human hand. Such a recording apparatus that records an image while scanning over a recording medium with a human hand is called a hand-held recording apparatus, a hand-held printer, a hand-held mobile printer, or the like. Hereinafter, these are collectively referred to as hand-held mobile printers.

Hand-held mobile printers are capable of printing and recording on a sheet of paper freehand, thus achieving both the convenience in mobility and the sheet handling capability.

SUMMARY

In an aspect of the present disclosure, there is provided a hand-held recording apparatus includes a recording section, a housing, and an indicator. The recording section records an image on a recording material in moving in a scanning direction. The housing houses the recording section. The indicator is movable between an indication position at which the indicator opposes the recording material and indicates a recording area of the image of the recording section and a retracted position at which the indicator is retracted from the indication position.

In another aspect of the present disclosure, there is provided a hand-held recording apparatus that includes a recording section, a housing, a roller, and an indicator. The recording section records an image on a recording material. The housing houses the recording section. The roller guides movement of the housing in a scanning direction. The indicator is movable between an indication position at which the indicator opposes the recording material and indicates a recording area of the image of the recording section and a retracted position at which the indicator is retracted from the indication position.

In another aspect of the present disclosure, there is provided a hand-held recording apparatus that includes a housing, a roller, and an indicator. The housing houses a recording section to record an image on a recording material. The roller guides movement of the housing in a scanning direction. The indicator is movable between an indication position at which the indicator opposes the recording material and indicates a recording area of the image of the recording section and a retracted position at which the indicator is retracted from the indication position.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 3A is a perspective view of a state in which the indicator guide is open, and FIG. 3B is a schematic view of a bottom surface of the HMP;

Figure 1:
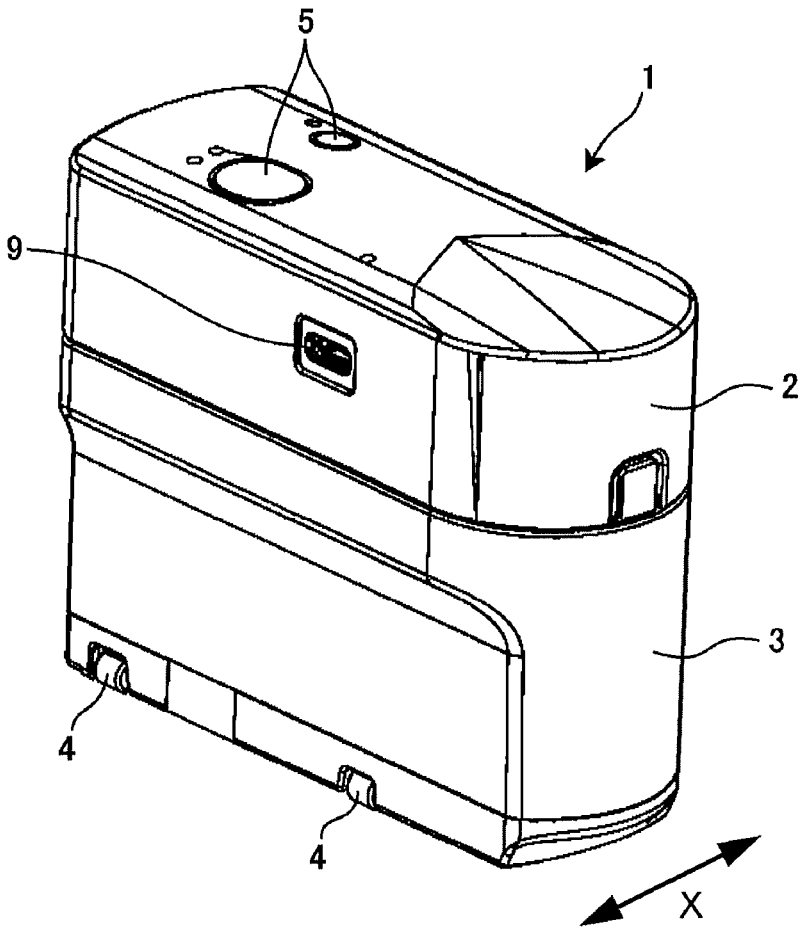
FIG. 1 is an external perspective view of a hand-held mobile inkjet printer (HMP) as a hand-held recording apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

Embodiments of the present disclosure are described below with reference to the attached drawings. FIG. 1 is an external perspective view of a hand-held-mobile-type inkjet printer (hereinafter abbreviated as HMP) which is a recording apparatus according to an embodiment of the present disclosure. Although the recording apparatus of the present embodiment is configured as an inkjet printer, embodiments of the present disclosure are not limited to an inkjet-type recording apparatus employing an method, and are applicable to a recording apparatus of an appropriate type, such as a thermal transfer type.

The HMP 1 illustrated in FIG. 1 includes an upper unit 2 and a lower unit 3. The upper unit 2 is mounted with a control board and includes operation-unit buttons 5 to operate, e.g., ink discharge timing and a universal serial bus (USB) connection port 9. The lower unit 3 is mounted with an inkjet head (discharge head). The lower unit 3 is provided with guide rollers 4 (as movement assist member to assist the movement of the HMP 1 in a scanning direction) to keep the straightness of operation in the horizontal direction of a body of the HMP 1.

Note that a so-called inkjet mechanism to perform recording by discharging liquid, such as ink, or liquid droplets from a head is well known, and redundant descriptions thereof are omitted here. Any inkjet mechanism of an appropriate configuration can be adopted as long as the inkjet mechanism can be mounted on the HMP 1. In the HMP 1 of the present embodiment, the inkjet mechanism corresponds to a recording unit that records an image on a recording material and is stored in a housing of the lower unit 3.

Figure 2:
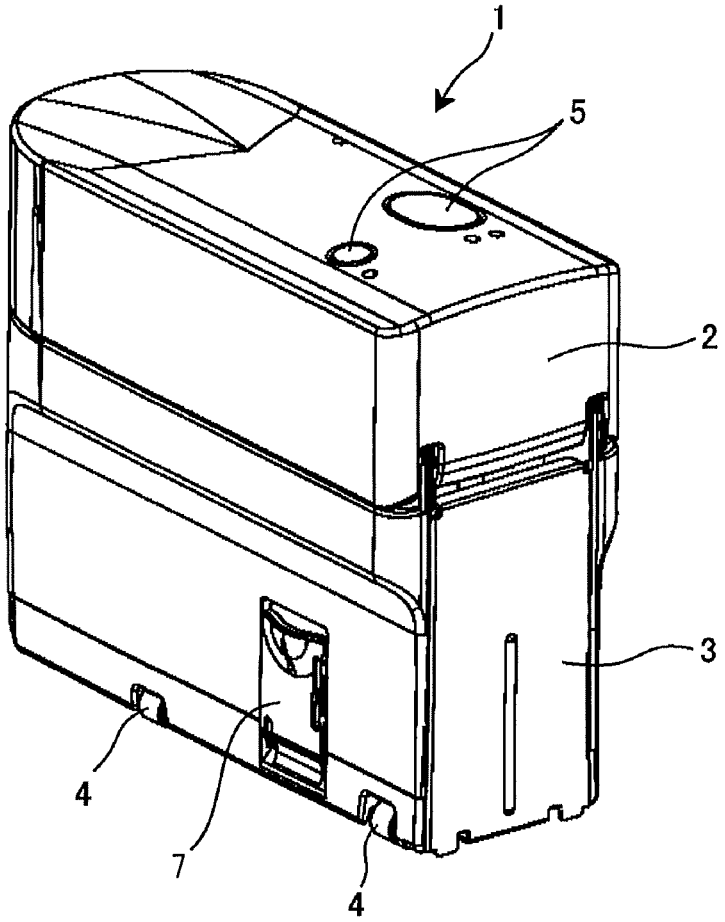
FIG. 2 is an external perspective view of the HMP seen from the opposite side of FIG. 1.

FIG. 2 is an external perspective view of the HMP 1 as seen from the opposite side of FIG. 1. As illustrated in FIG. 2, on one side surface of the lower unit 3, an indicator guide 7 is disposed as an indicator indicating the width of a recording area to be recorded by the recording unit. The indicator guide 7 is a guide member used to perform a line feed operation during printing. The structure of the indicator guide will be described later.

As illustrated in FIG. 1, the horizontal direction (short-side direction) of the body of the HMP 1 is defined as X direction, and the longitudinal direction of the body orthogonal to the horizontal direction is defined as Y direction. In printing operation using the HMP 1, when letters or pictures are linearly printed, the HMP 1 is moved in the X direction. Then, the HMP 1 is moved in the Y direction to perform line feed.

However, the printing operation using the HMP 1 is not limited to the above-described operation. For example, when letters, pictures, etc. are arranged in a design, printing may be performed by moving the HMP 1 in an oblique direction other than the X direction or in a curved manner, and line feed may be performed by moving the HMP 1 in a direction other than the Y direction.

As illustrated in FIG. 3, an ink discharge section 6 (image recording section) opened downward is disposed on a lower surface of the lower unit 3 of the HMP 1. Ink discharged from an inkjet head reaches a recording material, such as a sheet of paper, through an opening of the ink discharge section 6, to perform image recording.

Figure 3A:
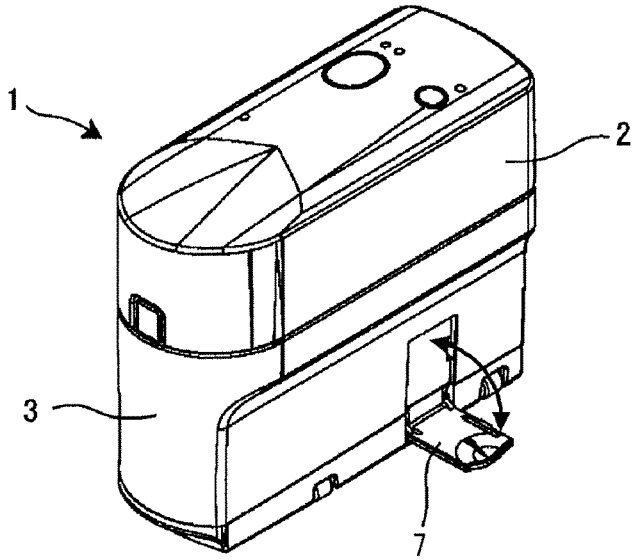
FIGS. 3A and 3B are illustrations of an example of the structure of an indicator guide of the HMP.
Figure 3B:
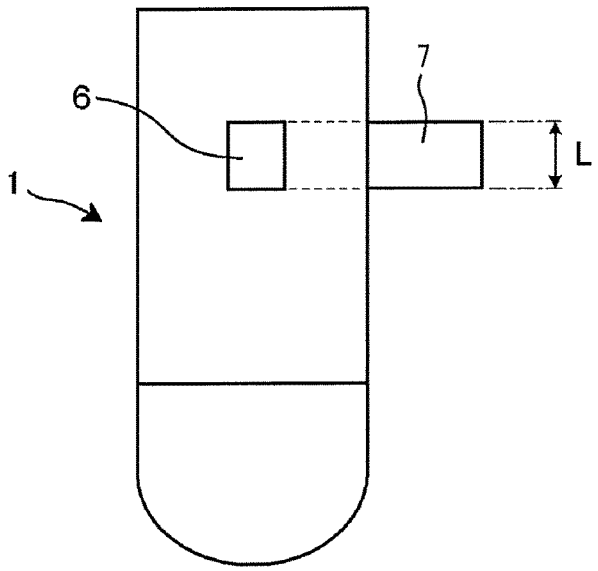

FIGS. 3A and 3B illustrate an example of the structure of the indicator guide 7. FIG. 3A is a perspective view of a state in which the indicator guide 7 is open. FIG. 3B is a schematic view of a bottom surface of the HMP 1. The indicator guide 7 is attached via a hinge near a lower end of the body (a side surface of the lower unit 3) of the HMP 1, and is disposed to be openable and closable with respect to the body (the side surface of the lower unit 3) of the HMP 1. When the indicator guide 7 is used, the indicator guide 7 is opened as illustrated in FIG. 3A. When the indicator guide 7 is not used, the indicator guide 7 can be retracted (stored in the side face of the body).

As illustrated in FIG. 3B, the indicator guide 7 is located on an extension line of the ink discharge section 6. The width (size in Y direction) L of the indicator guide 7 is the same as the width (size in the Y direction) of the ink discharge section 6. The color of the indicator guide 7 is transparent so that a user can see a part behind the indicator guide 7 through the indicator guide 7 or a recording material, such as a sheet of paper, under the indicator guide 7 in printing.

Figure 4:
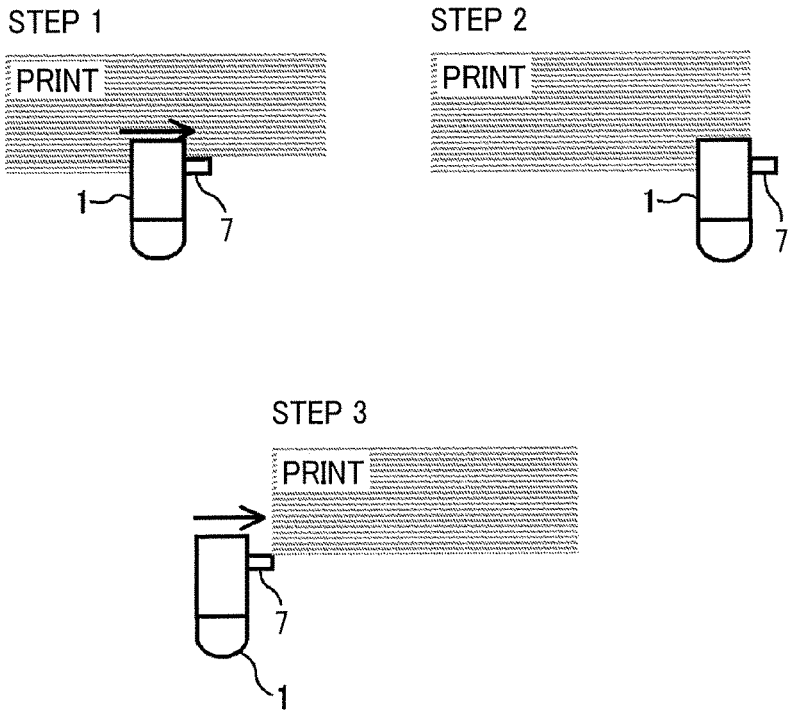
FIG. 4 is a schematic diagram illustrating a line feed operation in printing.

FIG. 4 is a schematic diagram illustrating a line feed operation in printing. Here, a description is given of a line feed operation performed when a plurality of lines is printed as in a normal printer (a non-portable printer including a sheet conveyance mechanism).

Step 1 in FIG. 4 illustrates a state in which a central portion of a printing area is printed. A user manually moves the HMP 1 in a direction from the left to the right (the X direction in FIG. 1) and performs free hand operation to print.

Step 2 in FIG. 4 illustrates a state in which the printing has been completed up to the right end of the printing area. When Step 2 is over, the body of the HMP 1 is temporarily floated from the sheet of paper (recording material) and a line feed operation is performed. The next printing range is clearly indicated by the indicator guide 7 (since an area to be printed next, that is, a recording area is indicated by the indicator guide 7). Accordingly, as illustrated in Step 3 in FIG. 4, aligning the upper edge of the indicator guide 7 to the bottom of an already-printed area facilitates appropriate line feed operation while preventing the next printing area from overlapping with the already-printed area or separating from the already-printed area with an extra gap (gap greater than necessary) or too-narrow gap.

Figure 5:
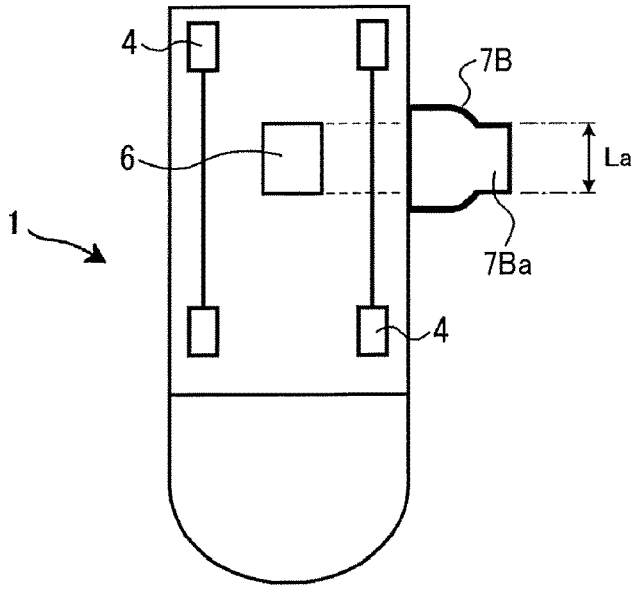
FIG. 5 is an illustration of a variation of the indicator guide.

FIG. 5 is an illustration of a variation of the indicator guide. In an indicator guide 7B illustrated in FIG. 5, the width (size in the Y direction) of a base portion is greater than the width of the ink discharge section 6. However, the width (size in the Y direction) La of a leading portion 7Ba is the same as the width (size in the Y direction) of the ink discharge section 6. As in the present variation, if at least a part of the indicator guide has the same width, that is, substantially the same size in the direction orthogonal to the scanning direction, as the ink discharge section 6, the next printing range can be easily grasped.

Figure 6:
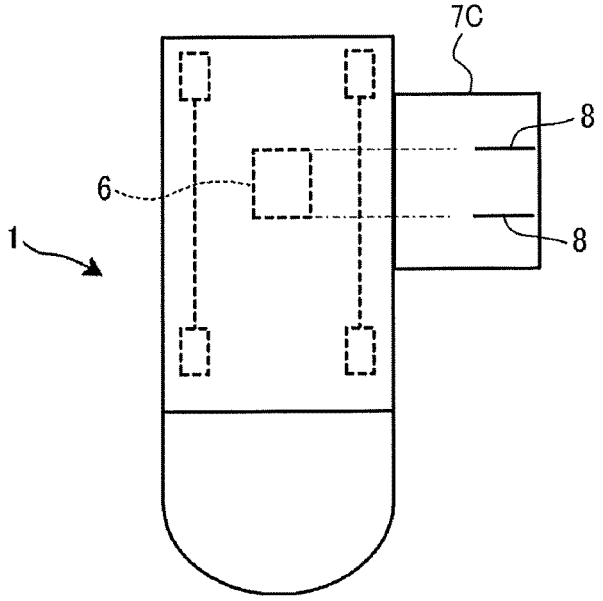
FIG. 6 is an illustration of another variation of the indicator guide.

FIG. 6 is an illustration of another variation of the indicator guide. The indicator guide 7C illustrated in FIG. 6 has a width (size in the Y direction) greater than the width of the ink discharge section 6. On an upper surface of the indicator guide 7C, marking shapes 8 are disposed on the same lines with both ends of the ink discharge section 6 in the Y direction. Note that, when the indicator guide 7C is a transparent member, the marking shapes 8 can also be disposed on a lower surface of the indicator guide 7C. In the variation illustrated in FIG. 6, the width (distance in the Y direction) between the marking shapes 8 formed as two straight lines is the same as the width of the ink discharge section 6. The marking shapes 8 on the indicator guide 7C allows the next printing range to be easily grasped even if the width (size in the Y direction) of the indicator guide 7C is greater than the width of the ink discharge section 6.

Figure 7:
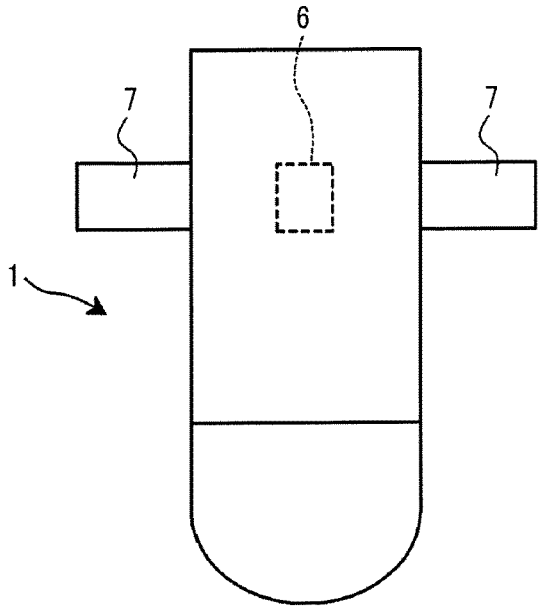
FIG. 7 is an illustration of a variation in which the indicator guide is disposed on both sides of a body of the HMP.
Figure 8:
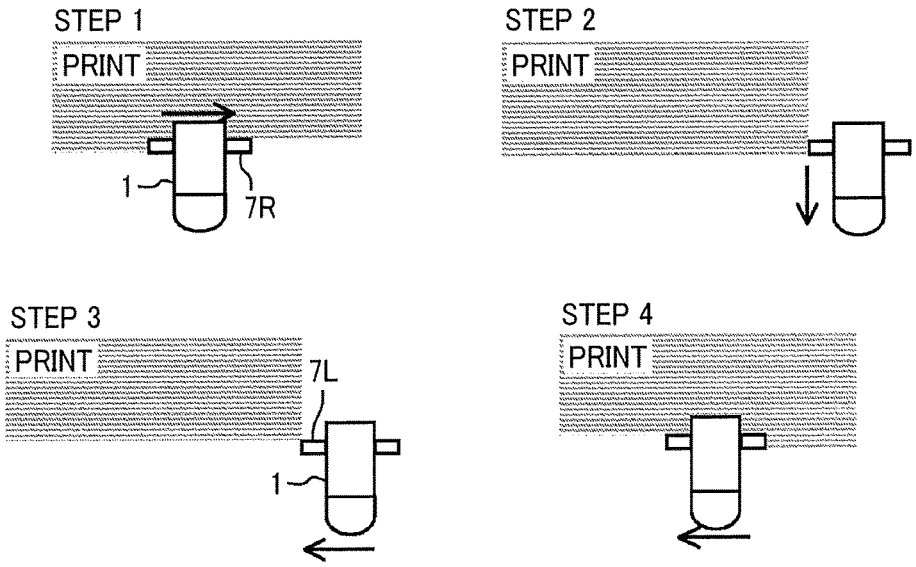
FIG. 8 is a schematic diagram illustrating a line feed operation in printing in the variation of FIG. 7.

FIG. 7 is an illustration of a variation in which the indicator guide is disposed on both sides of the body of the HMP. In a configuration of FIG. 7, the indicator guides 7 are disposed on both sides (in the X direction) of the body of the HMP 1. In such a configuration, printing can be performed regardless of whether the HMP 1 is moved forward or backward in the X direction. The printing operation is described with reference to FIG. 8. In FIG. 8, for convenience of explanation, the right-side one of the indicator guides 7 is referred to as an indicator guide 7R and the left-side one is referred to as an indicator guide 7L.

In FIG. 8, step 1 illustrates a state in which a central portion of a printing area is printed. A user manually moves the HMP 1 from the left to the right and prints while performing free hand operation. Step 2 in FIG. 8 illustrates a state in which the printing has been completed up to the right end of the printing area.

When step 2 ends, with the position of the HMP 1 in the X direction (horizontal direction in FIG. 8) kept unchanged, the HMP 1 is moved downward in FIG. 8 to perform line feed. At that time, as illustrated in step 3 in FIG. 8, aligning an upper edge of the indicator guide 7L to the bottom of an already-printed area facilitates appropriate line feed operation while preventing the next printing area from overlapping with the already-printed area or separating from the already-printed area with an extra gap (gap greater than necessary) or too-narrow gap. In step 4, printing is performed by moving in the direction opposite to step 1, that is, from right to left in FIG. 8.

In such a configuration, as in the case of FIG. 4, it is unnecessary to move the HMP 1 from the right end (one end in the X direction) of the printing area to the left end (the opposite end in the X direction) at line feed. Accordingly, the HMP 1 can be moved in a zig-zag manner to perform printing, thus saving time and work for the movement and allowing printing with line feed to be performed with a simpler operation.

In the configuration of FIG. 7, the indicator guides 7 of FIG. 3 are disposed on both sides of the body of the HMP 1 in the X direction. However, the indicator guide 7B of FIG. 5 may be disposed on each side of the body of the HMP 1 in the X direction. Alternatively, the indicator guide 7C of FIG. 6 may be disposed on each side of the body of the HMP 1 in the X direction. Further, the indicator guides 7, 7B, and 7C may be combined.

Next, another embodiment of the present disclosure illustrated as a hand-held-mobile-type inkjet printer (hereinafter referred to as HMP) that is a portable image forming apparatus is described below. First, a basic configuration of the HMP according to another embodiment is described.

Figure 9:
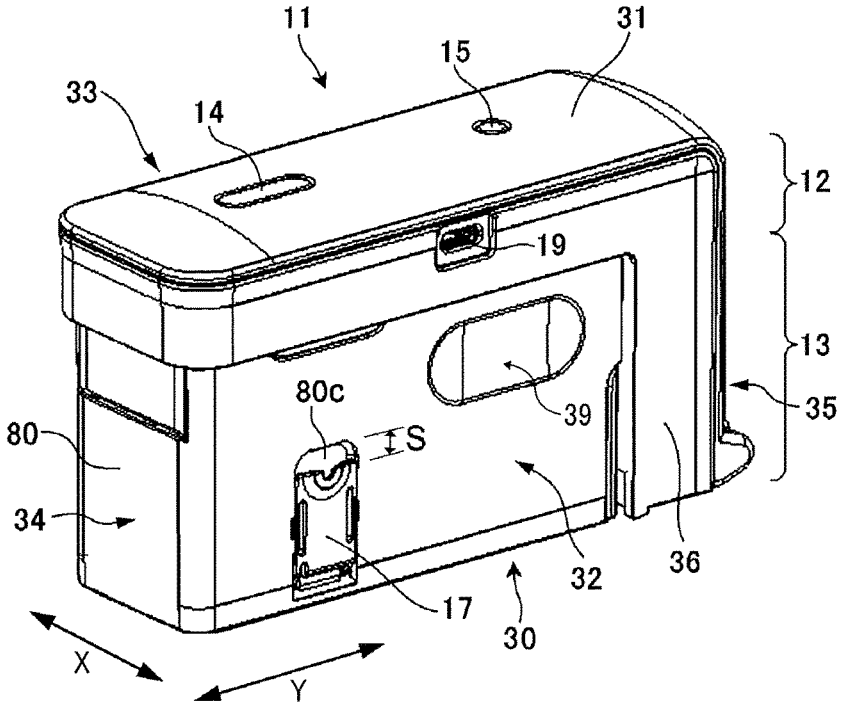
FIG. 9 is an external perspective view of an HMP according to another embodiment of the present disclosure, seen from obliquely above.

FIG. 9 is an external perspective view of an HMP 11 according to another embodiment, seen from obliquely above. The HMP 11 illustrated in FIG. 9 has a substantially rectangular parallelepiped shape. The width of the HMP 11 in a scanning direction (that is, a printing direction indicated by arrow X in FIG. 9) is such a width that the user can grasp with a palm.

A housing 80 of a lower unit 13 of the HMP 11 has a recording surface 30 (a lower surface of the HMP 11) including a recording section of an inkjet head, an upper surface 31 that is the opposite surface of the recording surface 30, and a left-side surface 32 extending in a scanning orthogonal direction (indicated by arrow Y in FIG. 9) which is a direction orthogonal to the scanning direction of the HMP 11. The housing 80 also has, for example, a right-side surface 33 extending in the scanning orthogonal direction (indicated by arrow Yin FIG. 9), a back surface 34 extending in the scanning direction (indicated by arrow X in FIG. 9), and a front surface 35 extending in the scanning direction.

The HMP 11 illustrated in FIG. 9 is in a posture in which the recording surface 30 is directed vertically downward and the upper surface 31, which is the surface opposite to the recording surface 30, is directed vertical upward. A print button 14 and a power button 15 are disposed within an outer edge (within a frame) of the upper surface 31. A USB connection port 19 is disposed on the left-side surface 32 of the upper unit 12.

The USB connection port 19 is a port for connecting a USB cable. When electric power is supplied from an external power supply to a rechargeable battery (51 in FIG. 13) mounted in the HMP 11 via the USB cable connected to the USB connection port 19, the battery can be charged.

An end portion of the lower unit 13 on the side of the front surface 35 is a grip portion 36 having a greater width in the Y direction than a width of a portion of the lower unit 13 other than the end portion. When the user moves the HMP 11 on a surface of the recording material in the scanning direction (indicated by arrow X in FIG. 9) for image formation, the user holds the grip portion 36 to move the HMP 11. A reason why the grip portion 36 is wider than the other portion in the scanning orthogonal direction is that in addition to making it easy to hold the HMP 11 by hand, the grip portion 36 is a battery accommodating portion described later. A concave portion 39 is formed on the left-side surface 32. The user can place a finger on the concave portion 39 to stably hold the HMP 11.

The user can hold down the power button 15 to switch on and off the power of the HMP 11. With the power turned on, a control board mounted in the upper unit 12 of the HMP 11 can acquire image information by Bluetooth (registered trademark) communication with, e.g., a smartphone. After the user places the HMP 11 on the surface of a recording material with the recording surface 30 facing the surface of the recording material, the user presses the print button 14 once and moves the HMP 11 along the scanning direction, thus forming an image on the surface of the recording material. The HMP 11 can form an image on the surface of the recording material both when the HMP 11 is moved forward along the scanning direction (indicated by arrow X in FIG. 9) by the user's moving operation and when the HMP 11 is moved backward along the scanning direction. Ink discharge from the inkjet head 40 may be performed continuously after the user presses and releases the print button 14 once, or may be performed only while the user presses the print button 14. The recording material is not limited to paper material, such as a sheet of paper, and may be, for example, overhead projector (OHP) sheet, cloth, cardboard, packaging container, glass, or substrate.

An indicator guide 17 as an indicator indicating the width of a recording area that is recorded by the recording section is rotatably mounted on the left-side surface 32 of the housing 80. In the state illustrated in FIG. 9, the indicator guide 17 is closed and stored in the left-side surface 32 of the housing 80.

Figure 10:
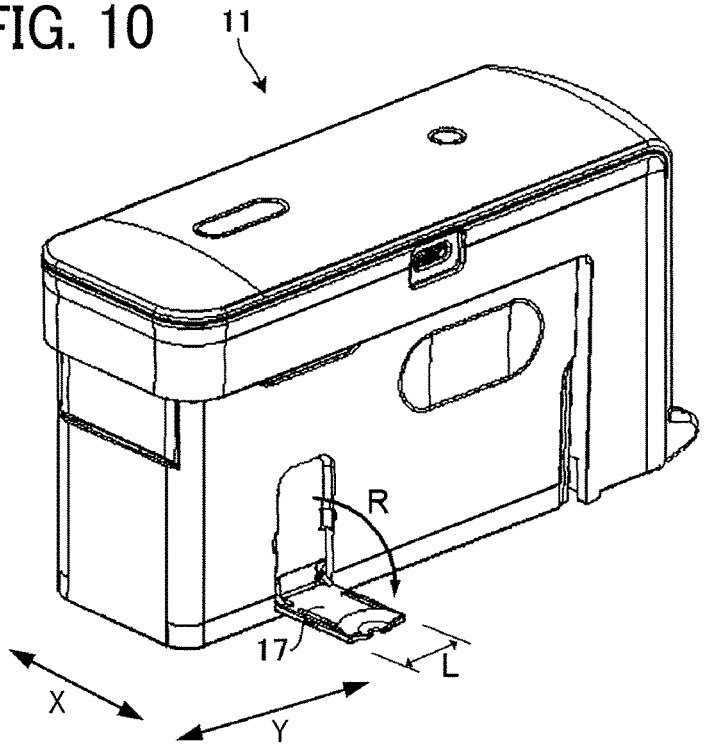
FIG. 10 is an external perspective view of the HMP of FIG. 9, which is seen from obliquely above, in a state in which the indicator guide is open.

FIG. 10 is an external perspective view of the HMP 11, which is seen from obliquely above, in a state in which the indicator guide 17 is opened. The user holds an upper portion of the indicator guide 17 stored in the housing 80 and rotates the upper portion of the indicator guide 17 as indicated by arrow R in FIG. 10, thus allowing the indicator guide 17 to be opened. As illustrated in FIG. 9, there is a gap S between the housing 80 and the stored indicator guide 17. That is, in the housing 80, a cutout 80*c* is formed at a position above an upper edge portion of the stored indicator guide 17. The gap S of the cutout 80*c* has a length that allows the user to insert his/her finger. Accordingly, the user can easily rotate the indicator guide 17 stored in the housing 80. The indicator guide 17 is formed of a transparent resin like the indicator guide 7 of the first embodiment. By operating the HMP 11 while comparing the positions of the indicator guide 17 and the surface of the recording material, the user can easily print on a desired position on the surface of the recording material. The width L of the indicator guide 17 in the scanning orthogonal direction (indicated by arrow Y in FIG. 9) is equal to the width of the recording section of the inkjet head 40 (the width of the recording area, which is the width of a plurality of discharge orifices 41*a* described later). Although the width L may be different from the width of the recording section, the width L is preferably not less than the width of the recording section of the inkjet head 40. Setting the width L of the indicator guide 17 to be equal to or greater than the width of the recording section of the inkjet head 40 can prevent overlapping of letters when, for example, the user prints two lines of letters adjacent to each other. In order to accurately grasp the printing position, the width L of the indicator guide 17 is preferably within +10% of the width of the recording section, more preferably within +5% of the width of the recording section.

The indicator guide 17 serving as an indicator is disposed between an indication position (FIG. 10) at which the indicator guide 17 is opposed to the surface of the recording material upstream or downstream of the recording section in the scanning direction and indicates a position of a recording area recorded by the recording section and a retracted position (FIG. 9) retracted from the indication position. The indicator guide 17 is movable between the stored position (FIG. 9) at which the indicator guide 17 is stored in the housing 80 of the HMP 11 and a protruding position (FIG. 10) protruding from the housing 80 of the HMP 11 to an upstream or downstream direction of the stored position in the scanning direction. Further, the indicator guide 17 is movable between the stored position (FIG. 9), at which the indicator guide 17 is stored in the housing 80 of the HMP 11, and an indication position (FIG. 10) indicating the recording area of the recording section. As a result, the print range and the recording range become clear, and the user can easily grasp the position of the recording area of the recording section and print at a desired position on the recording material. In addition, the indicator guide 17 does not become an obstacle at the time of storage at which the HMP 11 is not used, and can be stored without occupying a large space.

Instead of the configuration in which the indicator guide 17 is rotatable with respect to the housing 80, the indicator guide 17 may be configured to be able to move forward and backward in the scanning direction X from the housing 80. Instead of the configuration in which the indicator guide 17 is rotatable with respect to the housing 80 around the rotation shaft parallel to the scanning orthogonal direction Y, the indicator guide 17 may be rotatable around a rotation shaft parallel to the height direction of the HMP 11 (that is, a vertical direction relative to the surface of the recording material).

Figure 11:
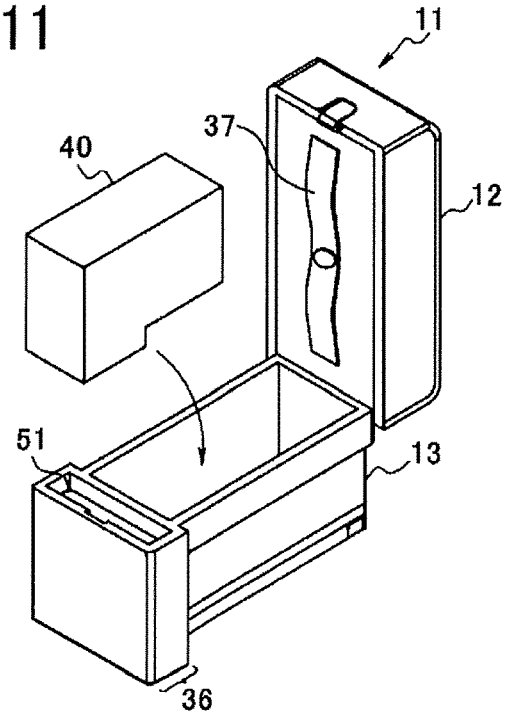
FIG. 11 is a perspective view of the HMP of FIG. 9 in a state in which an upper unit is opened with respect to a lower unit.

FIG. 11 is a perspective view of the HMP 11 in a state in which the upper unit 12 is opened with respect to the lower unit 13. As illustrated in FIG. 11, the upper unit 12 is held by the lower unit 13 to open and close with respect to the lower unit 13. A battery 51 to supply power to each device of the HMP 11 is mounted in an inner space of the grip portion 36 of the lower unit 13.

The inkjet head 40 (ink cartridge) integrated with an ink tank is detachably housed in a portion of the housing 80 of the lower unit 13 different from the grip portion 36. As illustrated in FIG. 11, the inkjet head 40, that is, the ink cartridge includes a recording section and an ink tank integrated as a single unit, and is detachable with respect to the housing 80 of the lower unit 13 of the HMP 11. At this time, the recording section to discharge ink droplets is directed downward in the vertical direction. The inkjet head 40 discharges ink droplets from the recording section to record an image on a recording material. The housing 80 detachably houses the recording section of the inkjet head 40. A head-pressing leaf spring 37 to press and hold the inkjet head 40 mounted in the lower unit 13 is fixed on the inner surface of the upper unit 12.

For the HMP 11, since the battery 51 is disposed on a side of the inkjet head 40 in the lower unit 13, the height of the HMP 11 is lower than in the configuration in which the battery 51 is disposed above the inkjet head 40. Thus, the position of the center of gravity of the HMP 11 is lowered, thus preventing the HMP 11 from falling over during the movement operation.

The size (apparatus width) of the HMP 11 in the scanning direction is slightly wider than the size of the inkjet head 40 in the scanning direction. Making the apparatus width as small as possible can widen the range in which the HMP 11 can be moved in the scanning direction on the surface of the recording material, and widen a recordable range on the surface of the recording material as much as possible.

Figure 12:
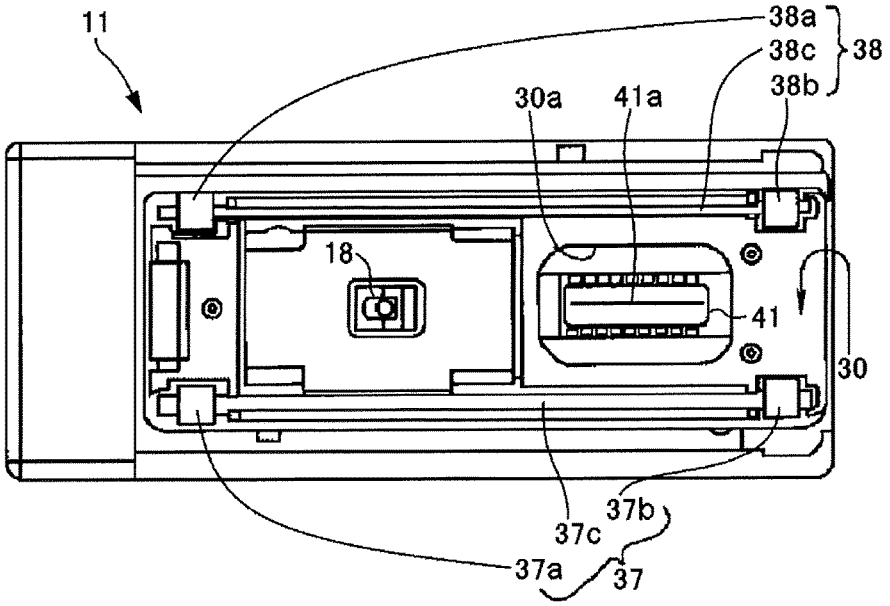
FIG. 12 is a bottom view of the HMP of FIG. 9 from a recording surface side.

FIG. 12 is a bottom view of the HMP 11 from a recording surface side. In FIG. 12, an opening 30*a* to expose the recording section 41 of the inkjet head 40 mounted in the lower unit 13 (FIG. 11) to the outside is disposed on the recording surface 30 as the recording surface of the HMP 11. The recording section 41 has a plurality of discharge orifices 41*a*, thus allowing ink droplets to be separately discharged from the respective discharge orifices 41*a* by driving piezoelectric elements. The width of the recording area in which an image is recorded by the recording section 41 corresponds to the width of the plurality of discharge orifices 41*a*. As a driving source to discharge ink, the inkjet head 40 employs, for example, piezoelectric actuators (lamination-type piezoelectric elements or thin-film-type piezoelectric elements) or electrostatic actuators including electrothermal transducer elements, such as heating resistors, made of diaphragms and opposed electrodes.

The "liquid" discharged from the discharge orifices 41*a* of the recording section 41 is not particularly limited as long as the liquid has a viscosity and a surface tension that can be discharged from the discharge orifices 41*a*. However, it is preferable that the viscosity is 30 mPa·s or less under normal temperature and pressure or under heating or cooling. Specifically, the term "liquid" represents, for example, a solution, a suspension, or an emulsion including a solvent, such as water or organic solvent, a colorant, such as a dye or a pigment, a polymerizable compound, a resin, a functional material, such as a surfactant, a biocompatible material, such as deoxyribonucleic acid (DNA), amino acid, protein, or calcium, or an edible material, such as a natural colorant. The above-described examples can be used, for example, for inkjet inks, surface treatment liquids, liquids for forming constituent elements of electronic elements and light-emitting elements or resist patterns of electronic circuits, and material liquids for three-dimensional fabrication.

Inside the outer edge of the recording surface 30 are disposed a position detection sensor 18 as a detector to detect the position of the HMP 11 on the recording material, a first rotatable left-side roller portion 37*a*, a second left-side roller portion 37*b*, a first right-side roller portion 38*a*, and a second right-side roller portion 38*b*. When the user moves the HMP 11 in the scanning direction, the four roller portions 37*a*, 37*b*, 38*a*, and 38*b* contacting the surface of the recording material rotate like tires. The roller portions 37*a*, 37*b*, 38*a*, and 38*b* allow the user to move the HMP 11 straight along the scanning direction while keeping a constant distance between the recording section 41 of the inkjet head 40 and the surface of the recording material. That is, the four roller portions 37*a*, 37*b*, 38*a*, and 38*b* guide the movement of the housing 80 of the HMP 1 in the scanning direction.

The position detection sensor 18 is a sensor that detects the distance to the surface of the recording material and the surface state (for example, irregularities) of the recording material and detects the moving distance of the HMP 11, and is a sensor of a similar type to a sensor used in, for example, an optical mouse (pointing device) of a personal computer. The position detection sensor 18 irradiates, with light, a place (recording material) on which the position detection sensor 18 is placed, and reads the state of the place as a "pattern". The position detection sensor 18 sequentially detects how the "pattern" moves with respect to the movement of the position detection sensor 18, to calculate the movement amount.

Figure 13:
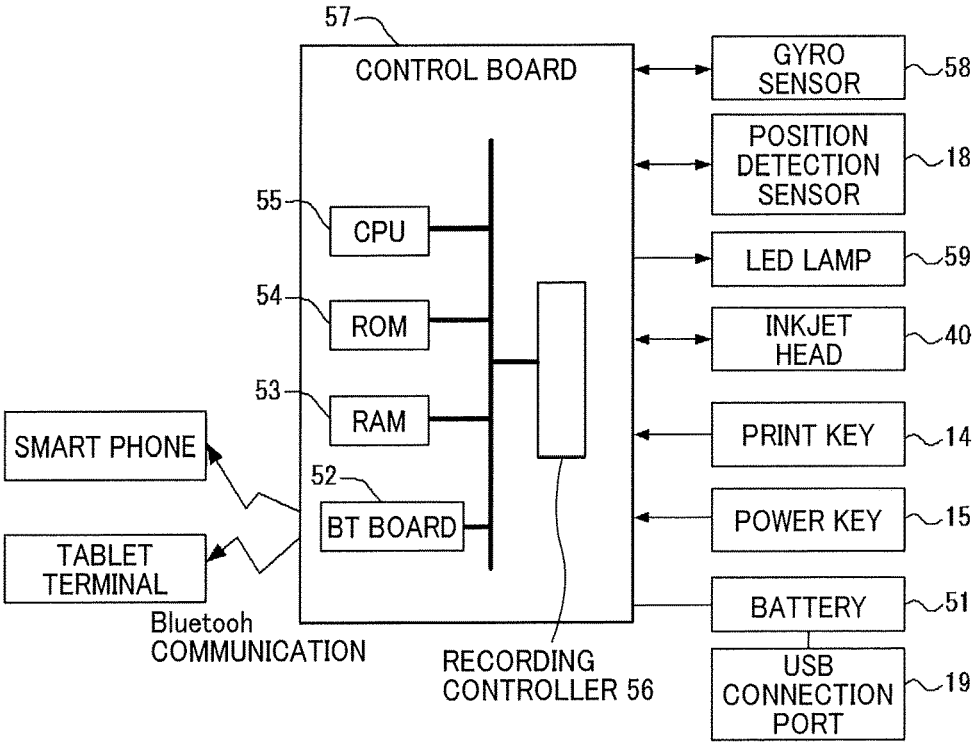
FIG. 13 is a block diagram of a part of an electric circuit of the HMP of FIG. 9.

FIG. 13 is a block diagram of a part of an electric circuit of the HMP 11. A control board 57 includes a central processing unit (CPU) 55 that performs various arithmetic processing and program execution, a Bluetooth (registered trademark) board (Bt board) 52, a random access memory (RAM) 53 that temporarily stores data, a read-only memory (ROM) 54, and a recording controller 56. The control board 57 is fixed at a position on the back side of the USB connection port 19 (illustrated in FIG. 9) in a hollow space of the upper unit 12 (illustrated in FIG. 9).

The Bt board 52 performs data communication by Bluetooth communication with an external device, such as a smartphone or a tablet terminal. The ROM 54 stores, for example, firmware for hardware control of the HMP 11 and drive waveform data of the inkjet head 40. The recording controller 56 executes data processing for driving the inkjet head 40 and generates drive waveforms.

The control board 57 is electrically connected to a gyro sensor 58, the position detection sensor 18, a light emitting diode (LED) lamp 59, the inkjet head 40, the print button 14, the power button 15, the battery 51, and the like.

The gyro sensor 58 detects the tilt and rotation angle of the HMP 11 and transmits the result of detection to the control board 57. The LED lamp 59 is disposed inside an exterior cover made of a light transmissive material in the print button 14 and causes the print button 14 to emit light.

When the power button 15 is pressed to turn on the power of the HMP 11, power is supplied to each module. The CPU 55 starts a starting operation based on the program stored in the ROM 54 and develops the program and each data in the RAM 53. When image data to be formed is received from an external device by Bluetooth communication, the recording controller 56 generates a drive waveform corresponding to the image data. The discharge of ink from the inkjet head 40 is controlled so as to form an image corresponding to the position on the surface of the recording material detected by the position detection sensor 18.

Figure 14:
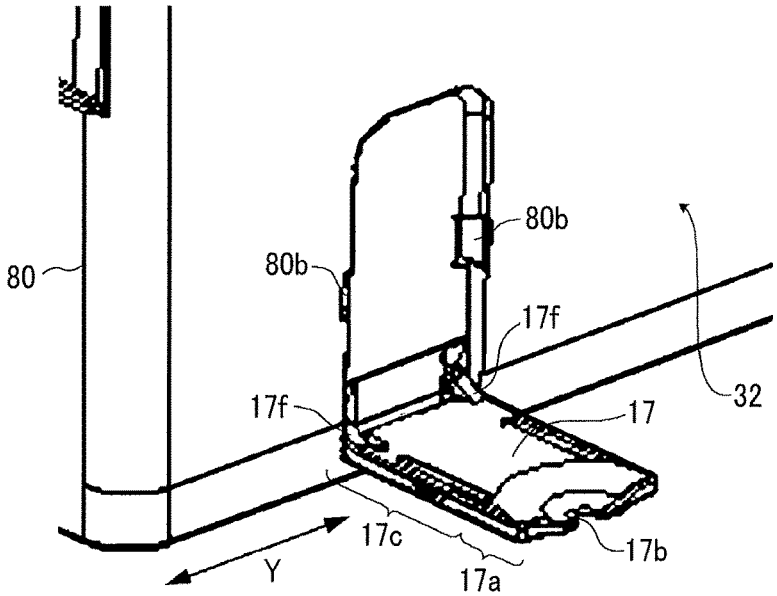
FIG. 14 is an enlarged perspective view of the indicator guide of the HMP of FIG. 9.

FIG. 14 is an enlarged perspective view of the indicator guide 17 of the HMP 11. The indicator guide 17 has a pair of arms 17*f*, a base portion 17*c* supported by the pair of arms 17*f*, and a projecting end portion 17*a* extending from the base portion 17*c* in the scanning direction. The projecting end portion 17*a* has a notch 17*b* as a center-position indicating portion at a position corresponding to a center position of the recording section in the scanning orthogonal direction. Since the notch 17*b* is formed, the user can easily grasp the center position of the width of a recording area in the scanning orthogonal direction, and perform accurate printing at a desired position. A pair of claws 80*b* is provided on the left-side surface 32 of the housing 80. The pair of claws 80*b* are engaged with both ends of the indicator guide 17 in the scanning orthogonal direction indicated by arrow Y of FIG. 14, thus holding the indicator guide 17 at the stored position in the left-side surface 32 (see FIG. 9).

Figure 15:
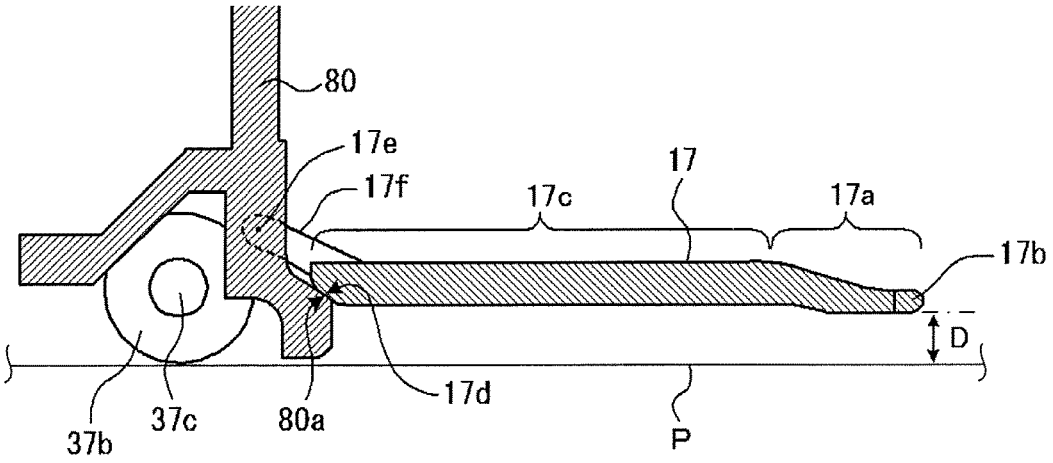
FIG. 15 is an enlarged sectional view of a vicinity of the indicator guide of the HMP of FIG. 9.

FIG. 15 is an enlarged sectional view of the vicinity of the indicator guide 17 of the HMP 11. The indicator guide 17 is supported by the housing 80 at a position of a fulcrum 17*e* disposed on each arm 17*f*. The arm 17*f*, the base portion 17*c*, and the projecting end portion 17*a* of the indicator guide 17 are rotatable with respect to the housing 80 about the fulcrum 17*e*. On the surface of the base portion 17*c*, there is an abutting portion 17*d* that can abut an abutted portion 80*a* on the surface of the housing 80. The user can release the engagement between the pair of claws 80*b* and the indicator guide 17 and rotate the indicator guide 17 in the direction indicated by arrow R (see FIG. 10). When the indicator guide 17 is rotated to the position illustrated in FIG. 15, the abutting portion 17*d* abuts the abutted portion 80*a*, thus restricting the rotation of the indicator guide 17. The abutting portion 17*d* and the abutted portion 80*a* as stoppers restricts the indicator guide 17 to a position at which a lower surface of the indicator guide 17 has a predetermined gap D from a recording material (a sheet of paper P). In such a state, only the four roller portions 37*a*, 37*b*, 38*a*, and 38*b*, including the second left-side roller portion 37*b* of the HMP 11, are in contact with the surface of the recording material, and the indicator guide 17 remains separated from the recording material. As described above, the abutting portion 17*d* and the abutted portion 80*a* can keep the indicator guide 17 separated from the recording material. When the user moves the HMP 11 to record an image on the recording material, such a configuration can prevent the indicator guide 17 from contacting the image on the recording material, thus preventing the recorded image from being disturbed.

In the present embodiment, the indicator guide 17 disposed on the downstream side of the HMP 11 (the side of the left-side surface 32) in the scanning direction X has been described. Instead of or in addition to such a configuration, the indicator guide 17 having the same configuration may be disposed on the upstream side of the HMP 11 (the side of the right-side surface 33) in the scanning direction.

In the case in which the indicator guides 17 are disposed on both the left and right sides of the housing 80, the user can more easily move the HMP 11 straight by operating the HMP 11 while comparing the positions of the pair of right and left indicator guides 17 and the surface of the recording material. In addition, keeping the pair of right and left indicator guides 17 away from the recording material can prevent the indicator guides 17 from contacting the recording material and damaging the surface of the recording material.

Note that, for the HMP 11 that can mount the inkjet head 40 (ink cartridge) including a recording section that records an image on a recording material, the HMP 11 may be configured to include the housing 80 capable of accommodating the inkjet head 40 (ink cartridge) and the recording section, the roller portions 37*a*, 37*b*, 38*a*, and 38*b* to guide movement of the housing 80 in the scanning direction, and the indicator guide 17 that is movable between a storage position stored in the housing 80 and an indication position indicating a recording area in which an image is recorded by the recording section. Also in such a case, the HMP 11 mounted with the recording section allows clear indication of a printing range or a recording range, facilitates printing to be performed at a desired position on the recording material, and allows the HMP 11 to be stored without occupying a large space.

As described above, the recording apparatus according to at least one embodiment of the present disclosure includes the indicator movable between the storage position stored in the housing and the indication position indicating a recording area in which an image is recorded by the recording section. Such a configuration can clearly indicate the printing range or recording range, facilitate printing to be performed at a desired position on a recording material, and store the recording apparatus without occupying a large space.

The indicator is disposed on the upstream side or the downstream side in the scanning direction with respect to the recording section, thus allowing easy grasp of the recording area or recording range. Further, the size of the indicator in the direction orthogonal to the scanning direction is substantially the same as the size of the recording section in the direction orthogonal to the scanning direction, thus allowing the next printing range or recording range to be indicated with a simple configuration.

Further, the size of at least a part of the indicator in the direction orthogonal to the scanning direction is substantially the same as the size of the image recording section of the recording unit in the direction orthogonal to the scanning direction, thus allowing the next printing range or recording range to be indicated with a simple configuration.

In addition, marking shapes located on the same lines as the both ends of the recording section in the direction orthogonal to the scanning direction are disposed on a part of the indicator, thus allowing the next printing range or recording range to be indicated with a simple configuration.

In addition, the indicator is a transparent member, thus allowing the user to see objects at the back of the indicator, a sheet of paper under the indicator, and the like.

Further, the indicators are disposed on both sides of the housing in the scanning direction, thus reducing the amount of movement at line feed. Further, the recording apparatus includes the movement assist member to assist the movement of the apparatus body in the scanning direction, thus enhancing the consistency between the recording before the line feed and the recording after the line feed and improving the image quality.

The indicator has the center-position indicating portion indicating a center position of the recording section in the direction orthogonal to the scanning direction at a position corresponding to the center position of the recording section. Thus, the center position of the width of the recording area in the scanning orthogonal direction can be easily grasped, thus allowing printing to be accurately performed at a desired position.

Further, the recording apparatus includes stoppers to regulate the position of the indicator so as to keep a predetermined gap between the indicator and the recording material when the indicator is at the indication position. Such a configuration can prevent the indicator from contacting an image on a recording material when the HMP is operated to move to record the image on the material, thus preventing disturbance of the recorded image.

The recording apparatus also has a gap between the housing and the indicator at the storage position, thus allowing the indicator stored in the housing to be easily rotated.

Although some embodiments of the present disclosure have been described based on the illustrated examples, embodiments of the present disclosure are not limited to the above-described embodiments. For example, any method can be adopted as long as the present invention can be applied. Further, the shape and size of the indicator can be appropriately modified.

The position and size of the recording section are also an example, and an appropriate configuration can be adopted. The scanning direction can also be arbitrarily set. Further, the recording apparatus according to an embodiment of the present disclosure is not limited to a printer but may be, for example, a device that receives data from a smartphone, a tablet terminal or the like and outputs the data. The method of receiving data is not limited to Bluetooth connection (wireless connection), but USB connection or any wired or wireless communication method can be adopted.

Although some embodiments of the present disclosure have been described above, the present invention is not limited to the above-described embodiments, and various variations and modifications are possible within the scope of the technical idea described in the claims. For example, although the shapes of the toner bottle 210, the outer electrode 215, and the inner electrode 216 are cylindrical in the above-described embodiment, the shapes of the toner bottle 210, the outer electrode 215, and the inner electrode 216 are not limited to such cylindrical shapes and may be any suitable shapes as long as the outer electrode 215 and the inner electrode 216 can be arranged as described in appended claim 1.

What is claimed is:

1. A hand-held recording apparatus comprising:

a recording section to record an image on a recording material in moving in a scanning direction;

a housing to house the recording section; and an indicator movable between an indication position at which the indicator opposes the recording material and indicates a recording area in which the image is recorded by the recording section and a retracted position at which the indicator is retracted from the indication position.

2. The hand-held recording apparatus according to claim 1, wherein the indicator is disposed upstream or downstream from the recording section in the scanning direction.

3. The hand-held recording apparatus according to claim 1, wherein a size of the indicator in a direction orthogonal to the scanning direction is substantially same as a size of the recording section in the direction orthogonal to the scanning direction.

4. The hand-held recording apparatus according to claim 1, wherein a size of at least a part of the indicator in a direction orthogonal to the scanning direction is substantially same as a size of the recording section in the direction orthogonal to the scanning direction.

5. The hand-held recording apparatus according to claim 1, wherein the indicator has marking shapes on same lines as both ends of the recording section in a direction orthogonal to the scanning direction.

6. The hand-held recording apparatus according to claim 1, wherein the indicator is a transparent member.

7. The hand-held recording apparatus according to claim 6, wherein the indicator is disposed on both sides of the housing in the scanning direction.

8. The hand-held recording apparatus according to claim 7, further comprising a movement assist member to assist movement of the housing in the scanning direction.

9. The hand-held recording apparatus according to claim 1, wherein the indicator has a center-position indicating portion at a position corresponding to a center position of the recording section in a direction orthogonal to the scanning direction, and wherein the center-position indicating portion indicates the center position of the recording section in the direction orthogonal to the scanning direction.

10. The hand-held recording apparatus according to claim 9, further comprising a stopper to restrict the indicator to a position at which the indicator forms a predetermined gap from the recording material when the indicator is at the indication position.

11. The hand-held recording apparatus according to claim 1, wherein the housing forms a gap from the indicator at the retracted position.

12. A hand-held recording apparatus comprising:

a recording section to record an image on a recording material;

a housing to house the recording section;

a roller to guide movement of the housing in a scanning direction; and an indicator movable between an indication position at which the indicator opposes the recording material and indicates a recording area in which the image is recorded by the recording section and a retracted position at which the indicator is retracted from the indication position.

13. The hand-held recording apparatus according to claim 12, further comprising a stopper to restrict the indicator to a position at which the indicator hag forms a predetermined gap between the indicator and the recording material when the indicator is at the indication position.

14. A hand-held recording apparatus comprising:

a housing to house a recording section to record an image on a recording material;

a roller to guide movement of the housing in a scanning direction; and an indicator movable between an indication position at which the indicator opposes the recording material and indicates a recording area in which the image is recorded by the recording section and a retracted position at which the indicator is retracted from the indication position.

15. The hand-held recording apparatus according to claim 14, further comprising a stopper to restrict the indicator to a position at which the indicator has forms a predetermined gap between the indicator and the recording material when the indicator is at the indication position.

* * * * *